US005507234A

United States Patent [19]

Thorsen

[11] Patent Number: 5,507,234

[45] Date of Patent: Apr. 16, 1996

[54] APPARATUS FOR CORRECTING SKEW OF A TRAVELING CRANE

[75] Inventor: George E. Thorsen, Wauwatosa, Wis.

[73] Assignee: Harnischfeger Corporation, Brookfield, Wis.

[21] Appl. No.: 342,857

[22] Filed: Nov. 21, 1994

[51] Int. Cl.[6] ..... B66C 9/00

[52] U.S. Cl. ..... 105/163.2; 212/275

[58] Field of Search ..... 105/163.1, 163.2; 212/273, 275, 312

[56] References Cited

U.S. PATENT DOCUMENTS

| | | | |
|---|---|---|---|
| 2,935,032 | 5/1960 | Tingskog | 105/163.2 |
| 3,095,829 | 7/1963 | Dehn | 105/163 |
| 3,543,690 | 12/1970 | Lee | 105/163.2 |
| 5,080,021 | 1/1992 | Thorsen | 105/163.2 |
| 5,119,737 | 6/1992 | Thorsen | 105/163.2 |
| 5,156,282 | 10/1992 | Thorsen | 105/163.2 |

FOREIGN PATENT DOCUMENTS

| | | | |
|---|---|---|---|
| 623813 | 9/1978 | U.S.S.R. | 105/163.2 |
| 906906 | 2/1982 | U.S.S.R. | 105/163.2 |
| 1533989 | 1/1990 | U.S.S.R. | 105/163.2 |

*Primary Examiner*—Mark T. Le
*Attorney, Agent, or Firm*—Michael, Best & Friedrich

[57] ABSTRACT

An overhead traveling crane adapted to be supported on a pair of spaced apart, generally parallel first and second rails, the crane comprising a frame having opposite first and second ends, a first drive wheel which is rotatably mounted on the first end of the frame and which is adapted to roll along the first rail, a first idler wheel which is rotatably mounted on the first end of the frame and which is adapted to roll along the first rail, a second drive wheel which is rotatably mounted on the second end of the frame and which is adapted to roll along the second rail, a second idler wheel which is rotatably mounted on the second end of the frame and which is adapted to roll along the second rail, a first motor mounted on the frame and drivingly connected to the first drive wheel, a second motor mounted on the frame and drivingly connected to the second drive wheel, an idler shaft connecting the idler wheels such that the idler wheels rotate at the same speed, a hoist moveable along the frame in a direction generally perpendicular to the rails, and a load engaging mechanism which is raised and lowered by the hoist.

17 Claims, 1 Drawing Sheet

APPARATUS FOR CORRECTING SKEW OF A TRAVELING CRANE

FIELD OF THE INVENTION

The invention relates to overhead traveling cranes which operate on spaced apart rails and, in particular, to the correction of skewing of such cranes on their rails.

BACKGROUND OF THE INVENTION

Overhead cranes which travel on wheels along spaced apart, generally parallel rails are subject to the continuous problem of the skewing of the crane on the rails. The forces causing skewing are due to rail displacement caused by rail support changes, rail deterioration resulting from improper adjustment of acceleration and deceleration forces of drive motors and brakes, and variations in traction due to rail contamination from moisture vapor and airborne particles. The skewing itself exacerbates the problem since it produces stresses on the rail structure which contribute further to the displacement of the rails. Moreover, the skewing causes severe stressing and wear of the crane wheels. The end result of rail displacement and deterioration and consequent increased skewing is a short wear life of the rails requiring their relatively frequent replacement and very frequent replacement of the wheels.

Various prior art solutions to the skewing problem have been developed. These include controls in which a sensing device is used for detecting skew and adjusting the drive motors of the crane to correct the skew. Another approach, upon sensing skew of the bridge, is to either apply a friction drag to the leading skewed end of the bridge or activate a wheel brake on the leading drive wheel of the skewed bridge. A further solution, disclosed in U.S. Pat. No. 3,095,829, in a crane having drive wheels driven and controlled independently, is to decrease the clearance between the rail and the outside flange of each of the drive wheels. Consequently, the outside flange of the leading drive wheel, when the crane moves to a skewed position, will contact the outer side of the rail on which it rides and cause that wheel as well as its drive system to slow down due to the resulting friction and thereby correct the skew. The skew sensing devices used in prior art skew correction methods have typically ben contacting devices such as rollers which are connected to switches and proximity type switches which will provide an output signal indicative of their distance from the rail.

U.S. Pat. No. 5,080,021 discloses an apparatus for correcting skew of a traveling crane operating on spaced apart rails in which the drive wheels always rotate at the same speed.

SUMMARY OF THE INVENTION

The invention provides an improved apparatus for correcting skew of a traveling crane in which the drive wheels are driven independently. Skew is substantially eliminated by connecting the idler wheels with an idler shaft so that the idler wheels rotate at the same speed. Preferably, the wheels have inside flanges as described in U.S. Pat. No. 5,080,021, which is discussed above. The idler shaft drives the idler wheel at the light end of the frame at the same speed as the idler wheel at the heavy end. This essentially prevents skewing when the crane is carrying a heavy load. Also, the idler shaft pulls the heavy end during acceleration.

This arrangement allows the crane to be operated at substantially higher speeds than would otherwise be possible, and allows reduction of the wheel base relative to the bridge span. Larger wheels (which provide better traction) and more powerful drive trains can be employed. Rail, runway support and building life are increased.

Other features and advantages of the invention will become apparent to those skilled in the art upon review of the following detailed description, claims and drawings.

Figure 1:
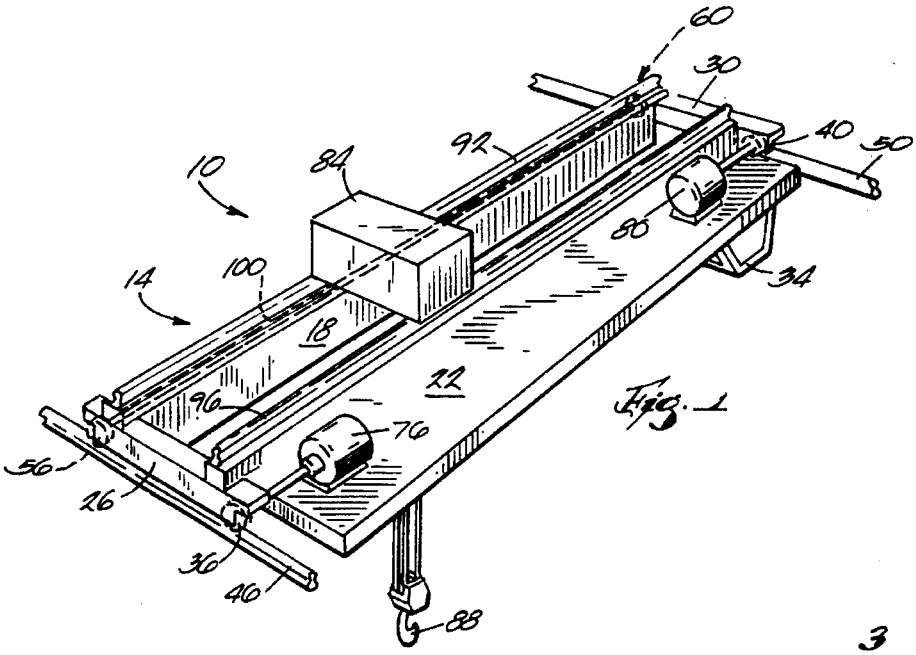
FIG. 1 is a perspective view of a traveling crane embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 2:
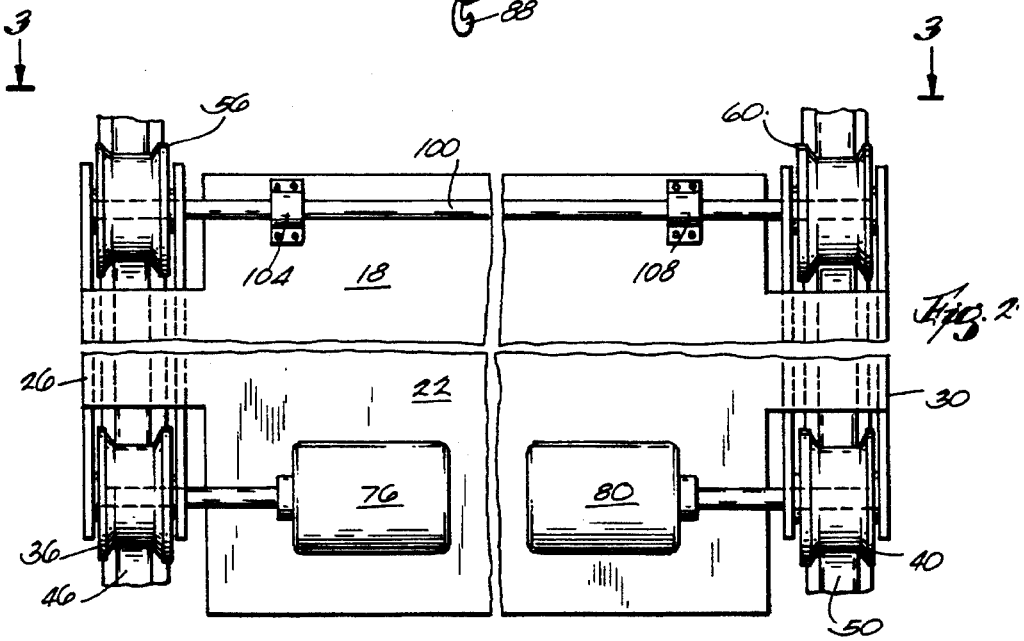
FIG. 2 is a plan view partially broken away.
Figure 3:
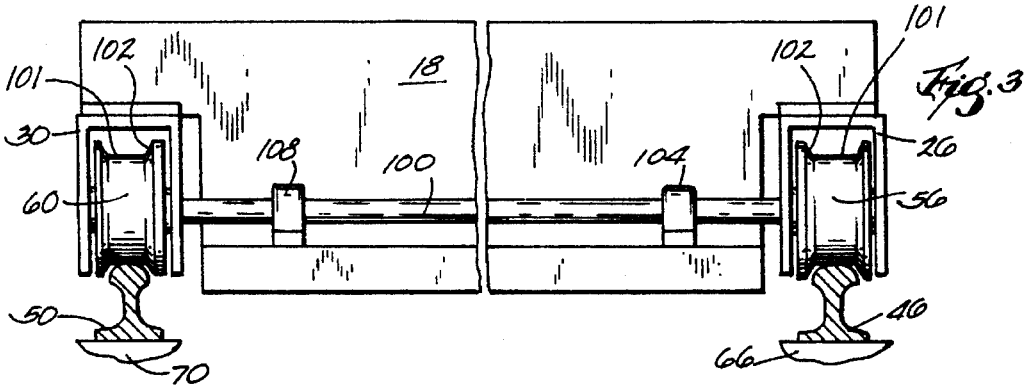
FIG. 3 is a view taken along line 3—3 of FIG. 2 and partially broken away.

An overhead traveling crane 10 embodying the invention is shown in the drawings. The crane 10 comprises (see FIG. 1) a frame 14 including a pair of bridge cross-members 18 and 22, and trucks 26 and 30 at opposite ends of the cross-members 18 and 22. An operator's cab 34 is suspended from the frame 14. Drive wheels 36 and 40 are respectively rotatably mounted on the trucks 26 and 30 in engagement with rails 46 and 50, respectively, so that the rails support the crane 10. Additional non-driven or idler wheels 56 and 60 are respectively rotatably mounted on the trucks 26 and 30 in engagement with the rails 46 and 50, respectively, for further support of the crane 10. The rails 46 and 50 are respectively mounted on beams 66 and 70 (see FIG. 3) or other suitable foundation means. The rotatable engagement of the drive and idler wheels with the rails permits travel of the crane 10 along the rails. Motors 76 and 80 (see FIGS. 1 and 2) are mounted on the frame 14 and drive the wheels 36 and 40, respectively. A hoist 84 (see FIG. 1) having a load hook 88 is supported for travel on tracks 92 and 96 which are respectively mounted on the cross-members 18 and 22 of the crane 10. The hoist 84 also includes motors (not shown) for moving the hoist along the tracks and for raising and lowering the load hook 88. The crane 10 may be operated by well-known controls, not shown, which control the operation of the motors 76 and 80, the movement of the hoist on the tracks, and the raising and lowering of the load hook 88.

In order to substantially eliminate skewing of the crane 10, the wheels 36, 40, 56 and 60 have inner steering flanges as described in U.S. Pat. No. 5,080,021, which is assigned to the assignee hereof and which is incorporated herein by reference, and the idler wheels 56 and 60 are connected by an idler shaft 100 (see FIGS. 2 and 3) so that the wheels 56 and 60 rotate at the same speed. Specifically, each of the wheels 56 and 60 has a cylindrical outer surface 101 and a radially outwardly extending flange with an outwardly-facing inside surface 102. The inside surface 102 of the wheel 56 faces the rail 46 and is angled away from the rail 46. The inside surface 102 of the wheel 60 faces the rail 50 and is angled away from the rail 50. The idler shaft 100 is supported on bridge member 18 by journal boxes 104 and 108. When the crane 10 is carrying a heavy load adjacent one end of the bridge or frame 14, the idler shaft 100 drives the idler wheel at the light end of the frame 14 at the same speed as the idler wheel at the heavy end, and the idler shaft 100 pulls the heavy end during acceleration. This allows the crane 10 to be operated at substantially higher speeds than would otherwise be possible, and allows reduction of the wheel base relative to the bridge span. Larger wheels, which provide better traction, and a more powerful drive train can be employed. Rail, runway support and building life are increased.

Various features of the invention are set forth in the following claims.

I claim:

1. An overhead traveling crane adapted to be supported on a pair of spaced apart, generally parallel first and second rails, said crane comprising a frame having opposite first and second ends, a first drive wheel which is rotatably mounted on said first end of said frame and which is adapted to roll along the first rail, a first idler wheel which is rotatably mounted on said first end of said frame and which is adapted to roll along the first rail, said first idler wheel having a radially outwardly extending flange with an inside wall facing outwardly and facing the first rail, said inside wall of said first flange being angled away from the first rail, a second drive wheel which is rotatably mounted on said second end of said frame and which is adapted to roll along the second rail, a second idler wheel which is rotatably mounted on said second end of said frame and which is adapted to roll along the second rail, said second idler wheel having a radially outwardly extending flange with an inside wall facing outwardly and facing the second rail, said inside wall of said second flange being angled away from the second rail, a first motor mounted on said frame and drivingly connected to said first drive wheel, a second motor mounted on said frame and drivingly connected to said second drive wheel, an idler shaft connecting said idler wheels such that said idler wheels rotate at the same speed, a hoist moveable along said frame in a direction generally perpendicular to the rails, and a load engaging mechanism which is raised and lowered by said hoist.

2. A crane as set forth in claim 1 wherein said frame includes spaced apart tracks extending generally perpendicular to the rails, and wherein said hoist is supported for movement along said tracks.

3. A crane as set forth in claim 1 wherein said load engaging mechanism is a hook.

4. A crane as set forth in claim 1 wherein said frame includes a pair of spaced apart, generally parallel bridge members.

5. A crane as set forth in claim 1 and further comprising at least one journal box mounted on said frame, and wherein said journal box rotatably supports said idler shaft.

6. An overhead traveling crane comprising a pair of spaced apart, generally parallel first and second rails, a frame having opposite first and second ends, a first truck attached to said first end of said frame, a first drive wheel which is rotatably mounted on said first truck and which rolls along said first rail, a first idler wheel which is rotatably mounted on said first truck and which rolls along said first rail, said first idler wheel having a radially outwardly extending flange with an inside wall facing outwardly and facing said first rail, said inside wall of said first flange being angled away from the first rail, a second truck attached to said second end of said frame, a second drive wheel which is rotatably mounted on said second truck and which rolls along said second rail, a second idler wheel which is rotatably mounted on said second truck and which rolls along said second rail, said second idler wheel having a radially outwardly extending flange with am inside wall facing outwardly and facing said second rail, said inside wall of said second flange being angled away from the second rail, a first motor mounted on said frame and drivingly connected to said first drive wheel, a second motor mounted on said frame and drivingly connected to said second drive wheel, an idler shaft connecting said idler wheels such that said idler wheels rotate at the same speed, a hoist moveable along said frame in a direction generally perpendicular to said rails, and a load engaging mechanism which is raised and lowered by said hoist.

7. A crane as set forth in claim 6 wherein said frame includes spaced apart tracks extending generally perpendicular to said rails, and wherein said hoist is supported for movement along said tracks.

8. A crane as set forth in claim 6 wherein said load engaging mechanism is a hook.

9. A crane as set forth in claim 6 wherein said frame includes a pair of spaced apart, generally parallel bridge members extending between said trucks.

10. A crane as set forth in claim 6 and further comprising at least one journal box mounted on said frame, and wherein said journal box rotatably supports said idler shaft.

11. A crane as set forth in claim 1 wherein each of said idler wheels has a cylindrical outer surface.

12. A crane as set forth in claim 6 wherein each of said idler wheels has a cylindrical outer surface.

13. An overhead traveling crane comprising a pair of spaced apart, generally parallel first and second rails, a frame having opposite first and second ends, a first truck attached to said first end of said frame, a first drive wheel which is rotatably mounted on said first truck and which rolls along said first rail, a first idler wheel which is rotatably mounted on said first truck and which rolls along said first rail, said first idler wheel having a cylindrical outer surface and a radially outwardly extending flange with a first inside wall facing outwardly and facing said first rail, said first inside wall being angled away from said first rail, a second truck attached to said second end of said frame, a second drive wheel which is rotatably mounted on said second truck and which rolls along said second rail, a second idler wheel which is rotatably mounted on said second truck and which rolls along said second rail, said second idler wheel having a radially outwardly extending flange with a second inside wall facing outwardly and facing said second rail, said second inside wall being angled away from said second rail, a first motor mounted on said frame and drivingly connected to said first drive wheel, a second motor mounted on said frame and drivingly connected to said second drive wheel, an idler shaft connecting said idler wheels such that said idler wheels rotate at the same speed, a hoist moveable along said frame in a direction generally perpendicular to said rails, and a load engaging mechanism which is raised and lowered by said hoist.

14. A crane as set forth in claim 13 wherein said frame includes spaced apart tracks extending generally perpendicular to said rails, and wherein said hoist is supported for movement along said tracks.

15. A crane as set forth in claim 13 wherein said load engaging mechanism is a hook.

16. A crane as set forth in claim 13 wherein said frame includes a pair of spaced apart, generally parallel bridge members extending between said trucks.

17. A crane as set forth in claim 13 and further comprising at least one journal box mounted on said frame, and wherein said journal box rotatably supports said idler shaft.

* * * * *

UNITED STATES PATENT AND TRADEMARK OFFICE

CERTIFICATE OF CORRECTION

PATENT NO. : 5,507,234

DATED : April 16, 1996

INVENTOR(S) : George E. Thorsen

It is certified that error appears in the above—identified patent and that said Letters Patent is hereby corrected as shown below:

Column 4, line 17, delete "am", insert -- an --.

Signed and Sealed this

Ninth Day of July, 1996

*Attest:*

*Attesting Officer*

BRUCE LEHMAN

*Commissioner of Patents and Trademarks*